United States Patent [19]

Bird

[11] Patent Number: 4,674,271

[45] Date of Patent: Jun. 23, 1987

[54] APPARATUS AND PROCESS FOR CONVERTING A CONTINUOUS MULTIFILAMENT YARN TO A STAPLE-LIKE YARN

[75] Inventor: David Owen Bird, Arnprior, Canada

[73] Assignee: BASF Corporation, Williamsburg, Va.

[21] Appl. No.: 874,922

[22] Filed: Jun. 16, 1986

[51] Int. Cl.[4] ..... D02J 1/00; D02J 3/02; D01G 1/00

[52] U.S. Cl. ..... 57/2; 28/115; 28/219; 28/252; 28/253; 57/90; 57/91; 57/206; 57/907

[58] Field of Search ..... 57/2, 907, 309, 206-209, 57/90, 91; 28/219, 107, 226, 115, 247, 140, 252, 253, 158, 159, 165, 170

[56] References Cited

U.S. PATENT DOCUMENTS

| | | | |
|---|---|---|---|
| 2,003,400 | 6/1935 | Taylor et al. | 57/2 |
| 2,191,417 | 2/1940 | Woolley | 57/2 |
| 2,232,496 | 2/1941 | Thompson | 57/2 X |
| 3,208,125 | 9/1965 | Hall et al. | 28/219 |
| 3,542,632 | 11/1970 | Eickhoff | 28/115 X |
| 3,645,080 | 2/1972 | Yamagata et al. | 57/2 |
| 4,019,311 | 4/1977 | Schippers | 57/2 X |
| 4,191,010 | 3/1980 | Lehmann et al. | 28/253 X |

*Primary Examiner*—John Petrakes

*Attorney, Agent, or Firm*—Rupert B. Hurley; Edward F. Sherer; Tom R. Vestal

[57] ABSTRACT

The present invention pertains to a process and product thereof, and an apparatus, for converting a twisted, continuous filament, multifilament yarn into a staple-like yarn. The process is carried out by needling the yarn with a barbed needle in order to break yarn filaments. The broken yarn filaments protrude from the yarn after the needling process. The protruding filament ends give the resulting yarn the appearance of a spun yarn.

12 Claims, 9 Drawing Figures

APPARATUS AND PROCESS FOR CONVERTING A CONTINUOUS MULTIFILAMENT YARN TO A STAPLE-LIKE YARN

BACKGROUND OF THE INVENTION

1. Field of the Invention

The present invention pertains to the field of textiles, more particularly to the field of stapilizing. The process and apparatus of the present invention use lateral deflection of a filament under tension with or without the presence of a shearing edge in order to form a "staple-like" twisted continuous filament yarn. The process utilizes barbed needling in order to apply tension forces to the filaments.

2. Description of the Prior Art

Applicant is aware of several U.S. patents that are related to the present invention, including: U.S. Pat. Nos. 3,542,632; 4,054,025; 4,145,870 and 4,297,837. Of these related patents, applicant believes U.S. Pat. No. 3,542,632 to be worthy of some discussion in order to distinguish Applicant's invention therefrom. Applicant believes the remainder of the art to be too distant from the present invention to be worthy of any detailed discussion.

U.S. Pat. No. 3,542,632 describes the use of barbed needles to fibrillate polyolefin ribbon yarns which have been woven into fabrics, in order that the fabrics take on:

> ". . . a hand and appearance similar to that of a fabric woven of natural fiber . . ." (claim 1, lines 2–4).

Applicant's invention differs from this patent in that Applicant is disclosing a process and apparatus for "stapilizing", not fibrillating. In other words, Applicant's invention utilizes barbed needles to break filaments across the longitudinal axis of the filaments whereas U.S. Pat. No. 3,542,632 describes the use of these barbed needles to split a ribbon yarn lengthwise. Furthermore, Applicant's invention pertains to twisted continuous filament yarns, whereas the reference pertains to ribbon yarns.

BRIEF SUMMARY OF THE INVENTION

The present invention encompasses a process for converting a continuous multifilament yarn to a staple-like yarn, and the product of said process. The present invention also encompasses a machine for carrying out said process. The process operates by first forwarding a multifilament yarn through an impingement zone in which zone the yarn is confined. A barbed needle impinges upon the yarn in the impingement zone. The barbed needle oscillates through the yarn so that the needle is first directed into contact with the yarn and is then directed out of contact with the yarn. The needle is sized, oriented and directed so that the needle both catches and breaks a small fraction of the filaments of the yarn during each oscillation of the needle through the yarn.

The apparatus of the present invention utilizes a yarn forwarding means, a yarn confining means, a needle oscillation means, and a barbed needle, in order to convert the twisted multifilament yarn into a staple-like yarn. The yarn forwarding means may be one or more pairs of nip rolls, or a winder, or any other yarn forwarding means known to those of skill in the art of textile manipulation. The yarn confining means can be a guide which positions the yarn for contact (impingement by the barbed needle). The needle oscillating means comprises a needle mounting means and a needle orienting means, the oscillating means directing the barbed needle into and out of contact with the yarn. The barbed needle has one or more relatively small barbs thereon, the barb size being commensurate with the filament diameter of the yarn being processed, so that the needle will catch and break only a small fraction of the yarn filaments during each oscillation of the needle.

It is an object of the present invention to needle a multifilament yarn with a barbed needle so as to break filaments of the multifilament yarn.

It is an object of the present invention to convert a twisted continuous multifilament yarn into a yarn having an appearance similar to a staple yarn.

It is an object of the present invention to break filaments in a twisted continuous multifilament yarn, the filament breaking occurring in a manner which causes filament ends to protrude from the yarn so that the yarn appears similar to a spun yarn.

It is an object of the present invention to disclose a simple, economic process for converting a twisted, continuous multifilament yarn to a staple-like yarn.

DETAILED DESCRIPTION OF THE PREFERRED EMBODIMENTS

Figure 1A:
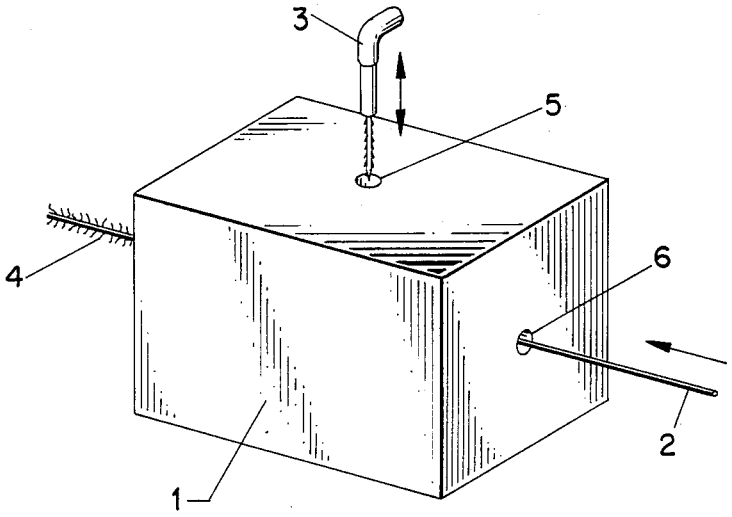
FIG. 1A is a perspective view of a preferred apparatus for carrying out the present invention.

FIG. 1A illustrates a most preferred apparatus and process of the present invention. A guide member (1) has a continuous, twisted, multifilament yarn (2) directed through a yarn passageway (6) therein, the yarn passageway (6) most preferrably being circular in cross-section, the yarn passageway most preferrably having a constant cross-sectional area, and the yarn passageway most preferrably having a linear longitudinal axis. A barbed needle (3) is shown (in FIG. 1B) partially within a needle guide chamber (5), the needle guide chamber being within the guide member (1). The needle guide chamber is most preferrably circular in cross-section and of constant cross-sectional area, and the yarn guide chamber most preferrably has a linear longitudinal axis. In the preferred guide member (1) shown in FIG. 1A, the longitudinal axis of the yarn passageway intersects the longitudinal axis of the needle guide chamber, these axes most preferrably being perpendicular. The intersection of the guide chamber with the yarn passageway is herein termed the barbed needle-impingement zone.

Furthermore, it is preferred that the needle guide chamber (5) be only large enough to permit smooth movement of the needle therein, in order to increase the efficiency of breaking filaments caught by the needle barbs. The barbed needle (3) is connected to a needle oscillation means (not shown), the needle oscillation means comprising means for mounting and orienting the barbed needle. The needle oscillation means also directs the needle into and out of contact with the yarn (2). It has been conceived that the needle oscillation means could operate via mechanisms similar to the mechanisms that sewing machines utilize in order to produce the oscillation of a sewing machine needle.

Figure 1B:
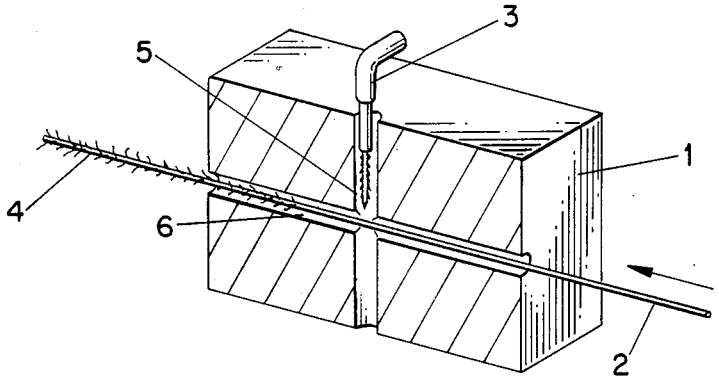
FIG. 1B is a cut-away view of the perspective view shown in FIG. 1A.
Figure 1C:
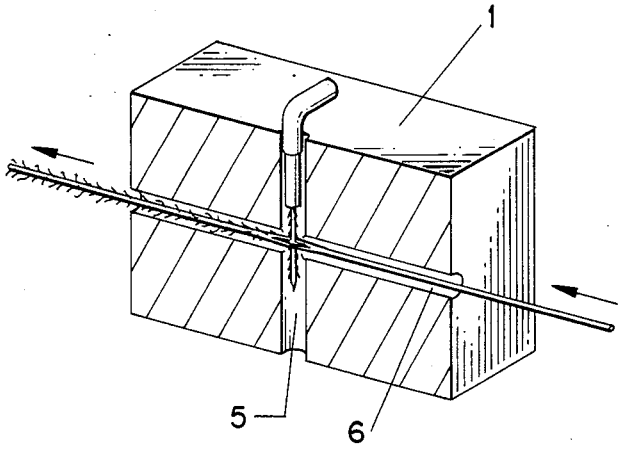
FIG. 1C is a cut-away view of a further point in the yarn treatment process, FIG. 1C illustrating a view similar to that view shown in FIG. 1B.

In FIG. 1A, the yarn (2) is being forwarded from right to left as indicated by a directional arrow in FIG. 1A. In addition, the barbed needle (3) is being oscillated up and down, as indicated by another directional arrow in FIG. 1A. FIG. 1B is a "stop action" view of the process, FIG. 1B illustrating a point in the process in which the needle (3) is completely "up", i.e. out of contact with the yarn. FIG. 1C illustrates a contrasting "stop action" view of the process, in which the needle (3) is almost all the way "down", i.e. has almost completed its travel through the yarn and after breaking filaments, will be ready to begin upward movement. As can be seen in FIGS. 1A, 1B and 1C, the yarn contains protruding filament ends (4) after the yarn (2) has been "converted" (i.e. treated) by the oscillating barbed needle (3).

In the process of the present invention, it is imperative that neither the needle (3) nor the yarn (2) be put under severe strain by forcing the yarn (2) to travel forward during the period of needle contact therewith. This can be achieved by either moving the yarn only while the yarn is not in contact with the needle, or by moving the needle very rapidly with respect to the speed of yarn travel.

Figure 2A:
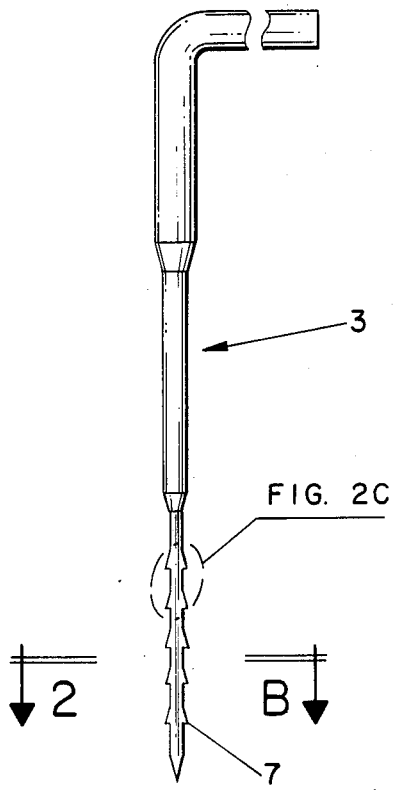
FIG. 2A is a perspective view of a preferred needle to be used in the apparatus and process of the present invention.
Figure 2C:
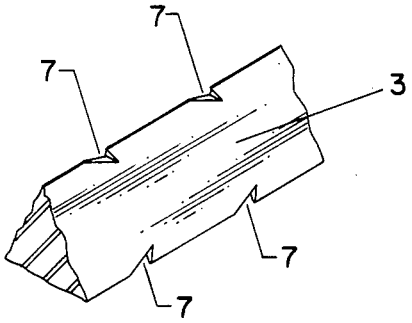
FIG. 2C is an enlarged, sectional perspective view of the barbed portion of the needle shown in FIG. 2A.
Figure 2B:
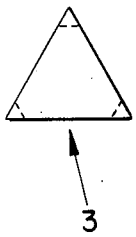
FIG. 2B is a cross-sectional view taken through line 2-B of FIG. 2A.

FIG. 2A illustrates a most preferred needle (3) to be used in the present invention, this needle being commonly known as a "felting needle". As can be seen in FIG. 2A, the needle barbs exist in rows parallel to the needle's longitudinal axis. The felting needle shown in FIG. 2A steps down from a large diameter to an intermediate diameter, and finally to a smallest "diameter". As shown in FIGS. 2B and 2C, the smallest "diameter" is actually triangular in cross-section, with the barbs positioned in three rows which lie along the vertices of the triangle. Since the axes of the continuous filaments of the twisted yarn (2) are substantially parallel with respect to one another, and are generally parallel to the axis of the yarn, it is imperative that at least one of the needle barbs be oriented in a direction so that the filament will "cross" the barb, i.e. so that the filament will be caught by the barb. Of course, with three sets of barbs as shown in FIGS. 2B and 2C, each set being directed from the vertex of an equilateral triangle, the needle will catch filaments of the yarn regardless of the "rotational position" of the needle in, for example, the needle guide chamber shown in FIG. 1A. The barbs should be sized commensurate with the filament diameter being processed, so that the barbs are large enough to catch and break at least one filament but not so large as to catch and break so many filaments at a single point that the yarn becomes weakened to an undesirable degree. In other words, the needle should catch and break only a small fraction of the filaments per oscillation. It is most preferred that the barb be large enough to catch and break only a single filament in a single needle oscillation. It is also important to limit the number of barbs in order to prevent undesirable weakening of the yarn. The needle barbs are not sharp enough to shear the yarn filaments. Instead, the barbs catch a filament and then stretch the filament so that a short portion of the filament is stretched beyond its residual elongation, breaking the filament. Furthermore, the amplitude of the oscillation which is necessary to break filaments has been found to vary depending upon the amount of twist in the yarn, and the degree of confinement of the yarn. The greater the twist in the yarn, the shorter the needle oscillation may be, and the greater the yarn confinement in the impingement zone, the shorter the needle oscillation may be.

Figure 3A:
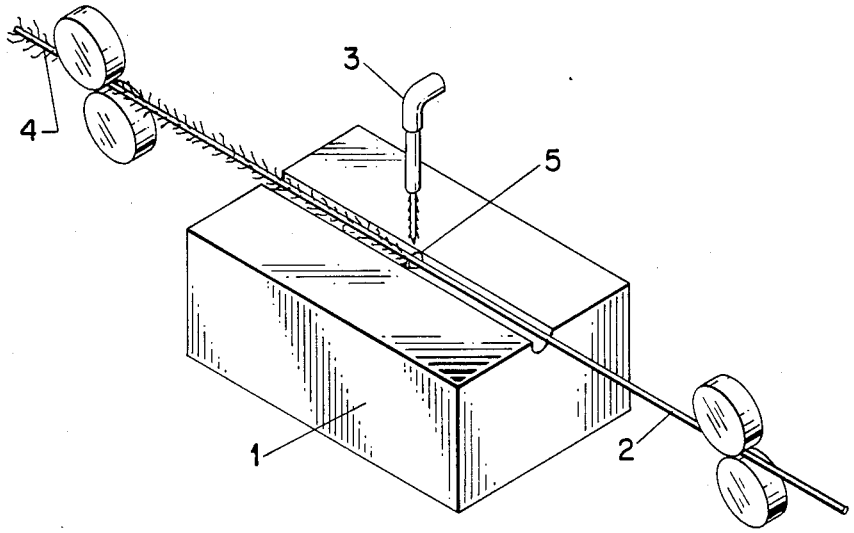
FIGS. 3A and 3B are perspective views of alternative apparati for carrying out the process of the present invention.
Figure 3B:
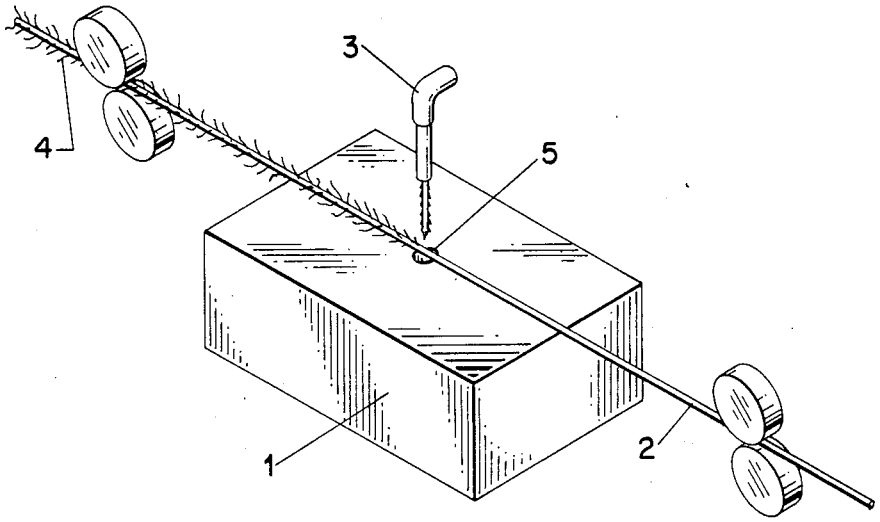
Figure 4:
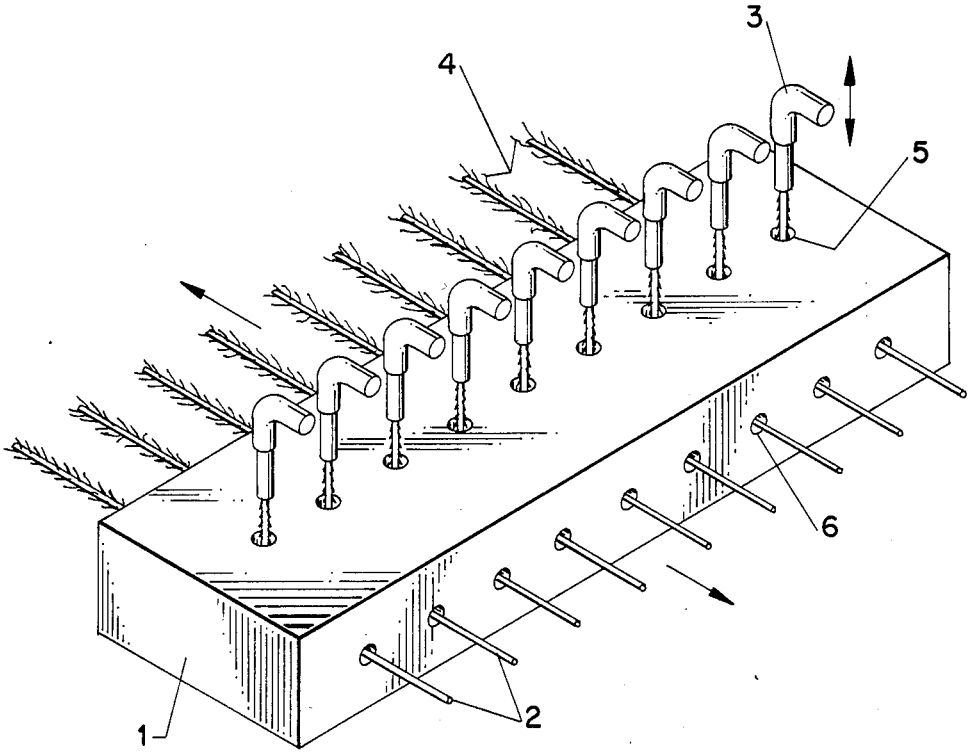
FIG. 4 is a perspective view of a preferred multiple position apparatus of the present invention.

The apparatus of the present invention utilizes a means to confine the twisted, continuous filament yarn. The means is most preferably a guide member such as the guide member (1) shown in FIG. 1A. In the preferred guide member as shown in FIG. 1A, the yarn (2) is confined in that it cannot shift so as to avoid impingement by the oscillating barbed needle, because the passageway is sized to prevent the yarn from shifting enough to avoid the needle. A second means of confining the yarn is to tension the yarn so that the yarn remains in a straight line between two points within the yarn tension zone, as shown in FIG. 3B. A third means of confining the yarn is illustrated in FIG. 3A, in which the yarn is in part confined by being positioned in a straight groove and is in part confined by tension being applied to the yarn so that the yarn in the groove remains in a straight line. The confinement of the yarn must be such that it not only ensures needle-yarn contact during needle oscillations, but also so that the confinement keeps the yarn path from changing due to the deflecting force exerted on the yarn by the barbed needle. Yarn path deflection by the barbed needle, if severe, could prevent the desired filament breakage by the needle. It has been conceived that there are at least two ways to prevent yarn path deflection: (a) by "supporting" the yarn in the vicinity of the impingement zone so that the yarn path cannot deflect in the direction of the force exerted by the needle, this being accomplished by making the needle chamber small enough to accommodate the needle only, and (b) applying so much tension to the yarn that it will not deflect significantly from the force of needle impingement. Thus, the yarn confinement means serves to both position the yarn and to prevent deflection of the yarn path. The impingement zone, broadly speaking, includes any region in which the needle and yarn come into contact. In FIGS. 1A, 1B, and 1C the impingement zone is defined by the intersection of the yarn passageway and the needle guide chamber. In FIG. 3A the impingement zone is that volume which is defined by the intersection of groove's volume and a volume extended infinitely upward above the needle guide chamber (5). In FIG. 3B the impingement zone is that volume which is defined by the intersection of the volume directly above the needle guide chamber (5) and the volume within which the yarn travels over the guide member.

The following examples are intended to describe embodiments of the apparati, and process, and product of the present invention.

EXAMPLE I

A twisted, 1300 denier, 68 filament polycaprolactam yarn was subjected to a manual needling operation in which the entire barbed portion of a felting needle was manually pushed through the yarn. The yarn had approximately 5 twists/inch. The yarn was not forwarded but was tensioned between two points while the needling operation was performed. The needle was pushed through the yarn about every 0.25 inches along the length of the yarn. The needle was a felting needle, obtained from The Torrington Company or Singer Co. Needle Division, 8 Stamford Forum. The yarn had the look of a spun yarn as many filament ends projected therefrom after the needling process.

EXAMPLE II

A 1300 denier, 68 filament polycaprolactam yarn is forwarded through a guide member as illustrated in FIG. 1A. The yarn has 5 twists per inch. A felting needle of the type used in Example I is impinged upon the yarn. The needle oscillations have an amplitude of approximately one inch, and the point of the needle clears the yarn completely by about one eighth inch when the needle reaches its highest position. The yarn passageway is rectangular in cross-section and has a width of 0.625 inches. The yarn passageway has a length of 6 inches. The guide member has a height of 3 inches. The needle guide chamber is circular in cross-section and has a length of 3 inches and a diameter of 0.0625 inches below the intersection of the yarn guide chamber and the yarn passageways. The yarn is intermittently forwarded by a mechanism similar to mechanisms utilized to forward fabric which is being sewn on a sewing machine. Likewise, the needle is mounted and oscillated by a mechanism similar to that found in a sewing machine. The needle is in contact with the yarn only while the yarn is not being forwarded. The yarn is impinged by the needle every 0.25 inches. The yarn emerges from the guide member with the general appearance of a spun yarn, as may different filament ends project therefrom.

I claim:

1. A process for converting a twisted, continuous multifilament yarn into a staple-like yarn, comprising the steps of:

(a) Forwarding the twisted, continuous multifilament yarn past a barbed needle-impingement zone, the yarn being confined in the vicinity of the needle-impingement zone; and (b) Oscillating a barbed needle through the yarn in the needle impingement zone, the needle oscillating so that the needle is directed into contact with the yarn followed by the needle being directed out of contact with the yarn, the needle having barbs thereon, the needle barbs being sized, oriented, and directed so that the needle both catches and breaks a small fraction of the filaments of the yarn during each oscillation of the needle through the yarn; wherein the yarn is intermittently fowarded in a manner such that the yarn is stationary during the period in which the needle and the yarn are in contact with one another.

2. A process as described in claim 1 wherein the yarn is confined in the vicinity of the barbed needle-yarn contact zone by directing the yarn through a passageway in a guide member, the passageway intersecting with a needle guide chamber which is also within the guide member.

3. A process as described in claim 2 wherein the cross-sections of both the passageway and the needle guide chamber are round, and the longitudinal axes of the passageway and the needle guide chamber intersect, and the axes are also substantially perpendicular to one another.

4. A process as described in claim 1 wherein the barbed needle is a felting needle.

5. A process as described in claim 1 wherein the size of the barbs on the barbed needle is proportioned to the size of the filaments in the multifilament yarn, the barbs being large enough to catch only one filament at a time.

6. An apparatus for converting a twisted, continuous multifilament yarn into a staple-like yarn, comprising:

(a) A yarn-forwarding means, the yarn-forwarding means forwarding the yarn through a barbed needle-impingement zone;

(b) a means for confining the yarn in the barbed needle-impingement zone;

(c) A barbed needle, the needle barbs being sized according to the particular yarn being processed, so that the needle will catch and break only a small fraction of the yarn filaments during each oscillation thereof; and, (d) A needle oscillation means, the needle oscillation means having a barbed needle mounting means thereon, the needle oscillation means comprising means for mounting and orienting the barbed needle, the needle oscillation means directing the needle into and out of contact with the yarn to a degree so that during oscillation of the needle through the yarn the needle both catches and breaks a small fraction of the filaments of the yarn; wherein the yarn-forwarding means forwards the yarn intermittently so that the yarn is stationary during the time that the needle is in contact with the yarn.

7. An apparatus as described in claim 6 wherein the means for confining the yarn is a guide member, the guide member having a yarn passageway therethrough and a needle guide chamber therein, the yarn passageway and the needle guide chamber intersecting to form a needle-impingement zone.

8. An apparatus as described in claim 7 wherein at least 10 multifilament yarns are confined and supported by a single guide member, the guide member having at least 10 yarn passageways therethrough and at least 10 needle guide chambers therein, the yarn passageways and needle guide chambers intersecting to form needle-impingement zones, the apparatus further containing sufficient yarn-forwarding means in order to forward a multifilament yarn through each of the yarn passageways, the apparatus containing sufficient needle oscillation means for oscillating a barbed needle within each needle guide chamber, the apparatus containing a sufficient number of barbed needles so that each needle guide chamber has a barbed needle position therein.

9. An apparatus as described in claim 7 wherein the means for confining the yarn is a guide member, the guide member having a yarn alignment groove thereon and a needle guide chamber therein, a volume defined by the intersection of the yarn alignment groove and the volume directly above the needle guide chamber intersecting forming the needle-impingement zone.

10. An apparatus as described in claim 6 wherein the yarn is confined by being tensioned and by being positioned immediately over a needle guide chamber within a yarn support member.

11. An apparatus as described in claim 6 in which the barbed needle is a felting needle.

12. An apparatus as described in claim 6 wherein the needle barbs are sized according to a filament size of the yarn which is to be processed, the needle barbs being large enough to catch and break only one filament of the yarn per oscillation of the needle.

* * * * *